US005083421A

United States Patent [19]

Raasch et al.

[11] Patent Number: 5,083,421

[45] Date of Patent: Jan. 28, 1992

[54] CLEANING DEVICE FOR A ROTOR OF AN OPEN-END SPINNING MACHINE

[75] Inventors: Hans Raasch; Waldemar Bech, both of Mönchengladbach; Wilhelm Oehrl, Erkelenz, all of Fed. Rep. of Germany

[73] Assignee: W. Schlafhorst AG & Co., Mönchengladbach, Fed. Rep. of Germany

[21] Appl. No.: 508,923

[22] Filed: Apr. 12, 1990

[30] Foreign Application Priority Data

Apr. 12, 1989 [DE] Fed. Rep. of Germany ..... 3911946

[51] Int. Cl.[5] ..... D01H 11/00

[52] U.S. Cl. ..... 57/302; 57/301

[58] Field of Search ..... 57/300–303, 57/263

[56] References Cited

U.S. PATENT DOCUMENTS

| | | | |
|---|---|---|---|
| 4,028,136 | 6/1977 | Kamp | 57/302 X |
| 4,058,963 | 11/1977 | Stahlecker | 57/302 |
| 4,125,991 | 11/1978 | Stahlecker | 57/302 |
| 4,135,354 | 1/1979 | Stahlecker | 57/302 |
| 4,548,030 | 10/1985 | Lauschke et al. | 57/301 X |
| 4,897,993 | 2/1990 | Raasch et al. | 57/302 |

FOREIGN PATENT DOCUMENTS

| | | |
|---|---|---|
| 2618094 | 11/1977 | Fed. Rep. of Germany . |
| 2629161 | 1/1978 | Fed. Rep. of Germany . |
| 3715934 | 11/1988 | Fed. Rep. of Germany . |

*Primary Examiner*—Daniel P. Stodola
*Assistant Examiner*—William T. Stryjenski
*Attorney, Agent, or Firm*—Herbert L. Lerner; Laurence A. Greenberg

[57] ABSTRACT

An open-end spinning machine has a rotor with a shaft, an opening and an interior with a fiber slipping surface terminating in a fiber collecting groove in a given plane. A cleaning device for cleaning the interior of the rotor includes an arm. A rotatable shaft connected to the arm is offset relative to and disposed at an angle relative to the rotor shaft. A support on the rotatable shaft has an end on which at least one cleaning tool is disposed. The support is rotatable about the rotatable shaft with the end describing an arc cutting across the given plane for delivering the at least one cleaning tool with a forward motion through the rotor opening to a portion of the interior of the rotor to be cleaned.

12 Claims, 2 Drawing Sheets

CLEANING DEVICE FOR A ROTOR OF AN OPEN-END SPINNING MACHINE

The invention relates to a cleaning device for cleaning interior surfaces of a rotor of an open-end spinning machine, in which the rotor has a fiber slipping surface terminating in a fiber collecting groove, the cleaning device including an arm to be delivered to the rotor opening and at least one cleaning device on the arm to be inserted into the rotor.

Increases in rotor speeds of up to 130,000 rotations per minute has also led to the rotor diameter, which is measured in the groove, being reduced to a dimension of approximately 30 mm. At such dimensions for a rotor groove, it becomes difficult to adequately insert cleaning tools through the small rotor openings in order to effectively remove built-up dirt particles, especially from the rotor groove.

A cleaning device for the rotors of an open-end spinning machine is known from German Published, Non-Prosecuted Application DE-OS 37 15 934 A1. In that cleaning device, a scraper is passed through the opening in the rotor and into the rotor groove at an angle, in order to remove the dirt therein. In order to ensure proper fitting into the rotor groove, the scraper is pressed against the base of the rotor, from which location it slides into the rotor groove. When the scraper is pressed against the base of the rotor, lateral forces are applied to the support of the scraper. That can lead to an extension of the support which in turn can lead to problems when the scraper is pulled out of the narrow rotor opening during its removal from the rotor. In addition, the lateral forces arising when the scraper is pressed against the base of the rotor result in an undefined amount of pressure on the rotor groove which can affect the cleaning action in a negative manner.

The amount of pressure exerted by cleaning tools on the internal walls of a rotor and specifically the pressure of the scraper in the rotor groove, is particularly important. Too little pressure will prevent complete cleaning of the rotor surfaces and the cleaning of the rotor grooves in particular, when using scrapers. Too high a pressure leads to unnecessary wear of the the cleaning tools and of the rotors.

A cleaning device for automatically cleaning spinning rotors is known from German Published, Non-Prosecuted Application DE-OS 26 18 094. That cleaning device moves from spinning location to spinning location for automatically cleaning spinning rotors and is equipped with a scraper element connected to the end of a bar or a blowpipe. The scraper element along with the bar or blowpipe is swung along an arc, as if on an arm, through the opening of the rotor and into the spinning rotor in such a way that it lies in the rotor groove. The arc is in the same plane as the rotor shaft or axle. Due to the circular swinging motion of the scraper element, a large rotor opening is required in order to be able to accurately insert the cleaning device in the rotor groove. Difficulties in inserting the cleaning tool therefore arise in rotors with small diameters when using such a device.

It is accordingly an object of the invention to provide a cleaning device for a rotor of an open-end spinning machine, which overcomes the hereinafore-mentioned disadvantages of the heretofore-known devices of this general type and with which the cleaning of rotors even with small diameters can be optimally carried out.

With the foregoing and other objects in view there is provided, in accordance with the invention, in an open-end spinning machine having a rotor with a shaft, an opening and an interior with a fiber slipping surface terminating in a fiber collecting groove in a given plane, a cleaning device for cleaning the interior of the rotor, comprising an arm, a rotatable shaft connected to the arm being offset relative to and disposed at an acute angle relative to the rotor shaft, a support on the rotatable shaft having an end, and at least one cleaning tool disposed on the end, the support being rotatable about the rotatable shaft and having a spatial form permitting the end to describe an arc cutting across the given plane for delivering the at least one cleaning tool with a forward motion through the rotor opening to a portion of the interior of the rotor to be cleaned.

Two motions are superimposed over one another during the rotational movement of the support. By angling the rotatable shaft, the plane which runs perpendicularly to the shaft and in which the arc along which the cleaning tool moves lies, is also set at an angle to the plane in which the rotor groove lies. When the support is turned, the cleaning tool performs a forward movement through the rotor opening and towards the portion of the rotor to be cleaned.

In accordance with another feature of the invention, the rotatable shaft is curved at an acute angle in the direction of the rotor shaft.

The space-saving motion of the cleaning tools is particularly supported by the fact that the rotatable shaft is also curved at an acute angle toward the rotor shaft. However, such a construction has been proven to be so difficult to represent in drawings, that no example of such an embodiment with such a characteristic has been included. The additional angling of the shaft produces an operational movement of the support within the cleaning head which appears as a corkscrew motion to the observer.

In accordance with a further feature of the invention, the at least one cleaning tool is mounted on the support in the direction of the motion of the end describing the arc.

In accordance with an added feature of the invention, the rotor has a wall with the fiber slipping surface, the support is formed or shaped in a direction opposite to the direction of rotation of the support, and the support overlaps the rotor wall without contacting the rotor wall after the support swings into an operating position during a cleaning process.

This overlapping is solely the product of the rotational movement which the support carries out around its rotatable shaft. The cleaning tool is therefore inserted through the rotor opening into the rotor bell with a turning movement and can be withdrawn in the same manner without coming into contact with the rotor walls. The construction of the support in this way thus permits a particularly compact construction of the cleaning head. The cleaning tool can be inserted into the bell of the rotor, while only requiring minimal space, specifically with rotors having very small openings.

For this purpose, the cleaning tool is most advantageously mounted on the support in such a way that it faces towards the end of the support which runs along the arc. In this way, the cleaning tool describes the same path as the end of the support. Due to the superimposed rotational and forward movement, the scraper for cleaning the rotor groove in particular can be exactly fitted into the rotor groove if the cleaning head has been previously positioned at the correct distance from the rotor. For this reason, positioning of the cleaning tool always takes place approximately in the center of the rotor opening.

In accordance with an additional feature of the invention, in the cleaning head, the at least one cleaning tool carried by the support is a scraper, a brush or a compressed air nozzle. However, it is possible for a combination of various cleaning tools or even all three of the above-mentioned tools to be carried simultaneously. In accordance with yet another feature of the invention, the compressed air nozzle is mounted on the end of the support.

In this way, the scraper can clean the rotor groove and the brush can clean the fiber sliding surface, while the compressed air nozzle blows the loosened dirt and fibers out of the rotor and cleans the brush and the scraper of accumulated dirt and fibers which may adhere to thereto after the cleaning process has been completed.

In accordance with yet a further feature of the invention, there is provided a controlled actuating device for swinging the support. In this way it is possible to exactly adapt the swinging movement to variations in rotor geometry, such as variations in rotor diameter.

In accordance with yet an added feature of the invention, the cleaning device has a drive of its own for driving the rotor during a cleaning process, the drive having an adjustment device for adapting the drive to different rotor diameters.

In accordance with a concomitant feature of the invention, there is provided a functional connection between the adjustment device and the support for limiting swinging of the support in dependence on the rotor diameter and the cleaning tool support.

Other features which are considered as characteristic for the invention are set forth in the appended claims.

Although the invention is illustrated and described herein as embodied in a cleaning device for a rotor of an open-end spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
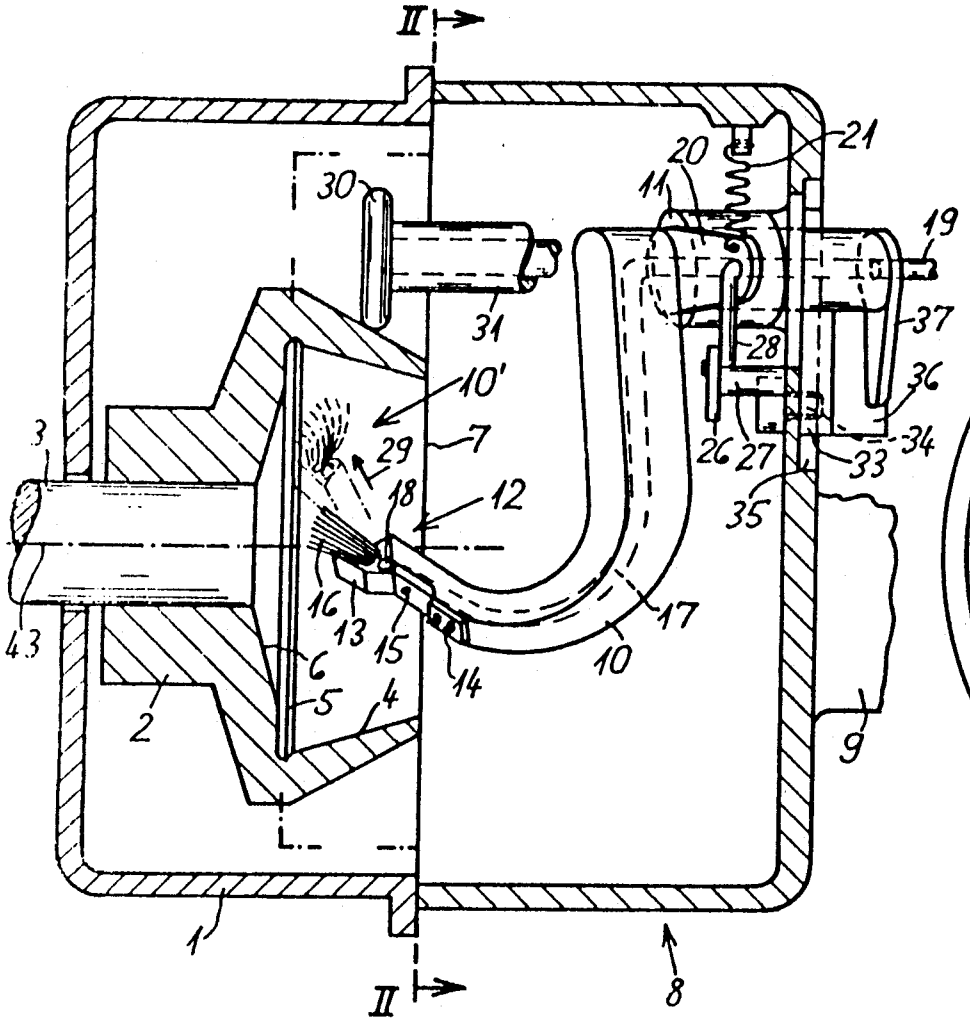
FIG. 1 is a fragmentary, diagrammatic, partly cross-sectional, top-plan view taken along the line I—I in FIG. 2, in the direction of the arrows, showing an opened cleaning head which is part of a cleaning device that is positioned at a spinning location for cleaning a rotor.

Referring now to the figures of the drawing in detail and first, particularly, to FIG. 1 thereof, there is seen a spinning box designated by reference numeral 1, in which a rotor 2 turns. The rotor 2 has a shaft 3 which passes through the rotor housing of the spinning box 1 and is driven by a non-illustrated drive. Other details of the spinning box are also not illustrated. The interior of the bell-shaped rotor 2 is equipped with a fiber sliding surface 4 which terminates in a fiber collecting groove 5. Yarn or thread formation is carried out there. The rotor has a base 6 which is angled in the direction opposite to the fiber sliding surface.

A cleaning head 8 which lies against the spinning box 1, is opposite an opening 7 of the rotor. The cleaning head 8 has been swung against the open spinning box by means of an arm 9 of a cleaning device which is not shown in further detail in the drawings, but is of the type known from German Published, Non-Prosecuted Application DE-OS 26 18 094, which moves from spinning location to spinning location along the open-end spinning machine.

Figure 2:
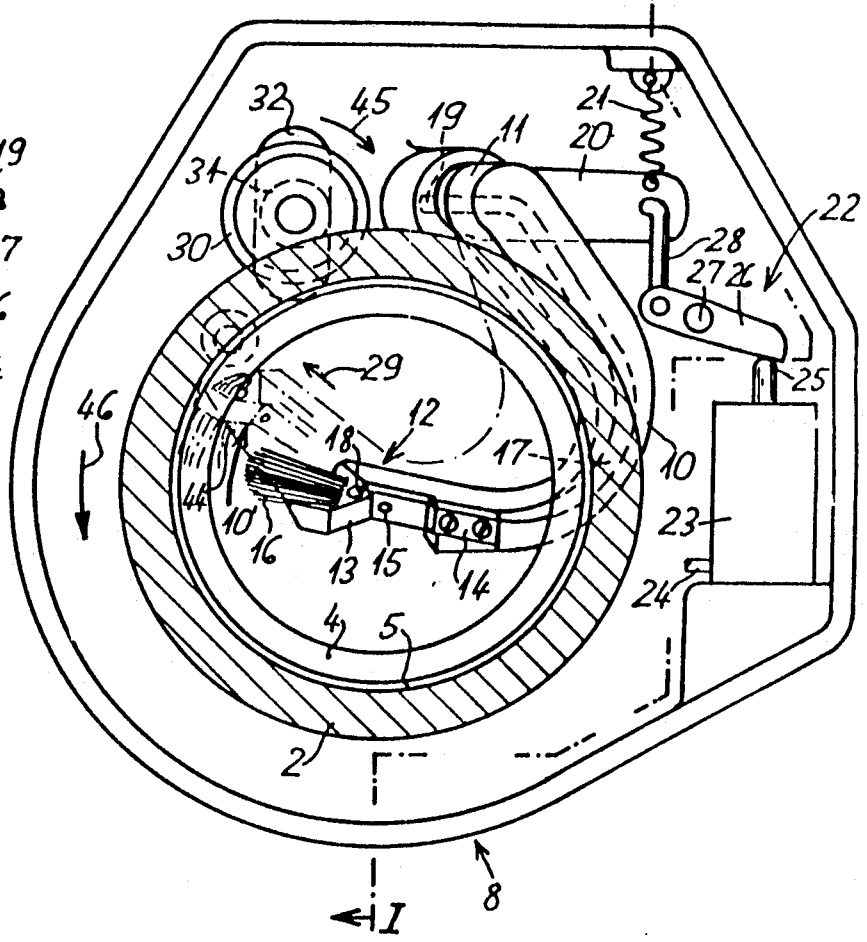
FIG. 2 is a longitudinal-sectional view of the cleaning head as seen from the rotor, which is taken along the line II—II in FIG. 1, in the direction of the arrows.

The cleaning head 8 is equipped with a support 10 which can rotate about a shaft or axle 11 that is mounted in the wall of the housing of the cleaning head 8. As can be seen in FIG. 2, the shaft 11 is set at an acute angle relative to the rotor shaft 3. In other words, the rotor shaft 3 points directly at the viewer, i.e. perpendicular to the plane of the drawing, while the shaft 11 is shown at an angle which is offset from being parallel to the rotor shaft by an acute angle. In the illustrated embodiment, the support 10 is attached to the shaft 11 at a right angle and has a corkscrew-like shape so that as viewed spatially, the end thereof points at an angle forward and to the left in the direction of the rotor opening.

The end 12 of the support 10 is equipped with cleaning tools which point in the direction of movement of the end 12. The tools include a scraper 13 which is moveably held in a mounting on the support 10 by a leaf spring and is prevented from sliding out by a tab 15 of the leaf spring. The scraper is angled and has a sloping end so that it can be easily inserted into the fiber collecting groove 5 and so that the point thereof faces against the direction of movement of the rotor during a cleaning process. A brush 16 located below the scraper 13 removes dirt from the fiber sliding surface 4. In addition, the support 10 is equipped with a feed channel 17 which terminates as a compressed air nozzle 18 at the end 12 of the support 10 between the scraper 13 and the brush 16. During the cleaning process, compressed air which blows out dirt removed by the brush 16 and the scraper 13 and which also blows off any dirt which may have accumulated on the brush 16 as well as on the scraper 13 after completion of the cleaning process, is blown through the feed channel 17 which is connected to an opening 19 in the shaft 11.

A rocking arm 20 is attached to the shaft 11. The arm 20 permits the shaft 11 to be turned and the support 10 to be swiveled with it. The support 10 is held in its rest position by a spring 21 which engages the rocking lever 20. The support 10 can be swung around its shaft 11 against the force of the spring 21 by means of an actuating device 22 which acts on the rocking lever 20.

The actuating device 22 is completely illustrated in FIG. 2. If the support 10 is to be rotated about its shaft 11, compressed air is fed through a feed hose 24 to a compressed air cylinder 23 through a non-illustrated valve which is actuated from a non-illustrated control unit. A piston 25 is pushed out of a compressed air cylinder 23 and presses against a lever 26, which is fixed at a fulcrum 27. When the lever 26 is turned about the fulcrum 27, a connecting rod 28 pulls the rocking lever 20 in a direction opposite to the motion of the piston 25. This causes the support 10 to be rotated about the shaft 11. As can be seen in a position 10' shown in phantom in FIG. 1 and in FIG. 2, the support 10 is moved in the direction of an arrow 29, in other words clockwise. The end 12 of the support with the attached cleaning tools facing in the direction of movement, moves along an arc 44 seen in FIG. 2, so that the rotatable shaft 11 vertically cuts the plane in which the arc 44 lies. The rotatable shaft 11 therefore provides means for rotating the support 10 with the end 12 describing the arc 44 cutting across the plane of the fiber collecting groove 5 for delivering cleaning tools with a forward motion through the rotor opening 7 to a portion 4, 5 of the interior of the rotor 2 to be cleaned.

Since the rotor 2 is disconnected from its drive source during the cleaning process, it is turned by a drive in the cleaning head 8. For this purpose, a rubber-covered friction wheel 30 which is driven through a shaft or axle 31 thereof by a non-illustrated drive source, lies on the outside of the rotor 2. For ease of illustration, the shaft 31 is broken off in FIG. 1 and openings therefor through the housing wall and the adjusting equipment are not shown.

FIG. 2 shows a view of the cleaning head 8 as seen from the the rotor. The slanted position of the shaft 11 of the support 10 can be clearly seen to point away toward the observer's left.

Figure 3:
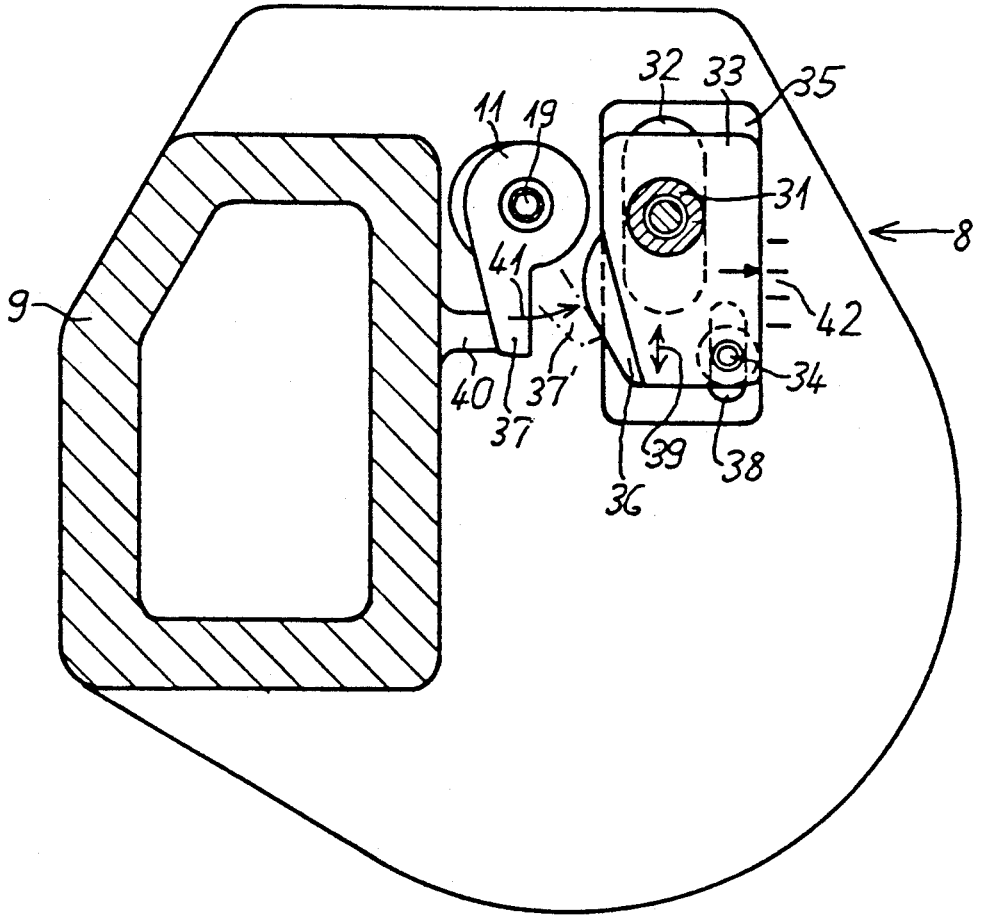
FIG. 3 is a partly sectional, rear-elevational view of the cleaning head.

It can be further seen that the shaft 31 of the friction wheel 30 can be moved in an elongated hole 32 in the housing wall. This makes it possible to drive rotors of various sizes. FIG. 3 shows a rear view of the cleaning head 8. This view shows the adjustability of the rotor drive particularly well. Adaptation to individual diameters takes place through the following adjusting mechanism. At the rear of the cleaning head 8, the shaft 31 is carried by a plate 33 attached to the housing of the cleaning head 8 by a screw 34. The plate 33 is moveably mounted in a recess 35 in the cleaning head housing. If the screw 34 is loosened, the plate 33 on which the shaft 31 of the friction wheel 30 is mounted, can be displaced along an elongated hole 32 within the recess 35 in the housing. The screw 34 also moves along an elongated hole 38 in the wall. Displacement can take place in the direction shown by arrows 39. In this way, it is possible to adjust the friction wheel 30 to fit the individual rotor diameter.

The plate 33 is also equipped with a link 36, against which a limit bar 37 attached to the shaft 11 impacts in a position 37'. By using the link 36 and the limit bar 37, it is possible to limit the swinging motion of the support 10. When at rest, the limit bar 37 sits against a tab 40 which represents a continuation of the arm 9, in the illustrated embodiment. If the support 10 is rotated about the shaft 11, the limit bar 37 moves in the direction shown by an arrow 41 until it hits the link 36. When the plate 33 is moved, the link 36 also moves, thus changing the point at which the limit bar 37 hits. In this way it is possible to adjust the swinging movement of the support 10 to various rotor diameters.

The drive of the friction wheel 30 is not illustrated. It can be produced by, for example, an electric motor which can be mounted on the plate 33.

The rotor cleaning process is carried out as follows:

A non-illustrated maintenance unit uses the arm 9 to position the cleaning head 8 in front of the opened spinning box 1 and centers it with respect to the rotor 2 with the aid of the friction wheel 30, which has been previously adjusted for the pertinent rotor diameter. For example, this adjustment can be carried out by aligning markings 42 on the plate 33 and those on the cleaning head housing opposite thereto.

In the centered position, the position of the support 10 can be aligned in such a way that the tip of the scraper 13 is always at the same height as a center line 43 of the rotor shaft 3 where it lies approximately in the center of the rotor opening 7. If compressed air is then supplied to the compressed air cylinder 23 through the feed hose 24 from a non-illustrated control unit, the piston 25 is pushed out and turns the lever 26 in a counter clockwise direction. The connecting rod 28 turns the rocking lever 20 and thus the support 10 in a clockwise direction around its shaft 11. During this motion, the support 10 swings in the direction shown by the arrow 29 and into the position 10', as shown by the phantom line. The end 12 of the support 10, and thus the point of the scraper 13 as well, move along the arc 44. The arc lies in a plane which not only has the angle of the shaft 11 relative to the plane of the drawing, but the end 12 of the support 10 and the scraper also have a corresponding slant at an angle relative to the center line 43 of the rotor shaft. The end 12 of the support 10 equipped with the cleaning tools moves along an arc in the direction of the rotor, it passes through the rotor opening 7 and moves into the bell of the rotor until the scraper 13 sits in the rotor groove. The limit bar 37 can be used to prevent too much downward pressure from being exerted. If the edge of the scraper 13 hits against the base of the rotor 2, the moveable mounting of the scraper allows it to give and tip in order to reduce the pressure A non-illustrated drive switches on the friction wheel 30 at the same time that the compressed air cylinder 23 is activated. The friction wheel 30 is driven in a clockwise direction as shown by the arrow 45, so that the rotor turns counterclockwise, in accordance with the direction shown by an arrow 46.

The direction of rotation of the rotor is the same as the direction in which the support 10 withdraws from the rotor. This ensures that the scraper cannot bind even with a large buildup of dirt in the rotor groove and the associated scraper friction. While the scraper 13 is cleaning the rotor groove 5, the fiber sliding surface is cleaned by the brush 16. At the same time, the compressed air nozzle 18 blows compressed air into the rotor so that the loosened contaminants can be blown out of the rotor bell.

At the end of the cleaning process, the compressed air supply to the compressed air cylinder 23 is stopped so that the spring 21 can push against the rocking arm 20 and pull the arm out of the rotor. However, during this movement to the rest position, compressed air continues to be supplied through the feed channel 17 to the compressed air nozzle 18 in order to blow off any dirt which may have adhered on the scraper 13 as well as the brush 16.

The drive to the friction wheel 30 is also switched off with the return swing of the support 10. Once the support 10 has reached its final position, that is once the limit bar 37 has hit the tab 40, the cleaning head can be swung out of the spinning box 1.

The shape of the support 10 permits a particularly compact construction of the cleaning head 8. Since the end 12 of the support 10 is always approximately centered in the rotor opening when the cleaning head is positioned, only a short swing path is required in order to place the scraper in the fiber collecting groove, even with rotors of varied sizes. The shape of the support permits a movement of the end 12 of the support 10 which allows the cleaning tools to be easily inserted into the rotor openings of even the smallest rotors in use today, without the danger of hitting the rotor or binding in it.

We claim:

1. In an open-end spinning machine having a rotor with a shaft having an axis, an opening and an interior with a fiber slipping surface terminating in a fiber collecting groove in a given plane, the axis being perpendicular to the given plane, a cleaning device for cleaning the interior of the rotor, comprising an arm, a rotatable shaft connected to said arm being offset relative to and disposed at an acute angle relative to a parallel of the rotor shaft axis, a support on said rotatable shaft having an end, and at least one cleaning tool disposed on said end, said support having a corkscrew-like shape and being rotatable about said rotatable shaft, said end describing an arc during rotation of said support cutting across the given plane for delivering said at least one cleaning tool with a forward motion through the rotor opening to a portion of the interior of the rotor to be cleaned, said arc defining another plane oriented at an acute angle relative to the given plane.

2. Cleaning device according to claim 1, wherein said rotatable shaft is additionally oriented at an acute angle in the direction of the rotor shaft.

3. Cleaning device according to claim 1, wherein said at least one cleaning tool is mounted on said support in the direction of said motion of said end describing said arc.

4. Cleaning device according to claim 1, wherein the rotor has a rotor wall with the fiber slipping surface, said support describes a direction of rotation when said end cuts across said given plane towards the rotor wall and said support is curved in a direction opposite to the direction of rotation of said support, and said support extends from said rotatable shaft across the rotor wall without contacting the rotor wall after said support swings into an operating position during a cleaning process.

5. Cleaning device according to claim 1, wherein said at least one cleaning tool includes a scraper.

6. Cleaning device according to claim 1, wherein said at least one cleaning tool includes a brush.

7. Cleaning device according to claim 1, including a compressed air nozzle disposed on said support.

8. Cleaning device according to claim 7, wherein said compressed air nozzle is mounted on said end of said support.

9. Cleaning device according to claim 1, including a controlled actuating device for swinging said support.

10. Cleaning device according to claim 1, including a drive of the cleaning device for driving the rotor during a cleaning process, said drive having an adjustment device for adapting said drive to different rotor diameters.

11. Cleaning device according to claim 10, including a functional connection between said adjustment device and said support for limiting swinging of said support in dependence on the rotor diameter.

12. In an open-end spinning machine having a rotor with an opening and an interior with a fiber slipping surface terminating in a fiber collecting groove in a given plane, a cleaning device for cleaning the interior of the rotor, comprising a support having a corkscrew-like shape with an end, at least one cleaning tool disposed on said end, and means for rotating said support with said end describing an arc defining another plane being disposed at an acute angle relative to the given plane, said end delivering said at least one cleaning tool with a forward motion through the rotor opening to a portion of the interior of the rotor to be cleaned when said support is rotated.

* * * * *